United States Patent [19]

Langley

[11] 4,026,086

[45] May 31, 1977

[54] BUILDING BRICK

[76] Inventor: David T. Langley, 1836 W. Venango St., Philadelphia, Pa. 19140

[22] Filed: July 18, 1975

[21] Appl. No.: 597,267

[52] U.S. Cl. ..... 52/582; 46/25; 52/594; 335/306

[51] Int. Cl.[2] ..... E04C 1/10; A63H 33/08; H01F 7/02

[58] Field of Search ..... 52/582, 594, DIG. 4; 46/25, 26; 335/302–306

[56] References Cited

UNITED STATES PATENTS

| | | | |
|---|---|---|---|
| 1,431,318 | 10/1922 | Martin | 52/594 |
| 2,345,029 | 3/1944 | Brooks | 335/305 |
| 2,612,541 | 9/1952 | Armond | 335/306 |
| 3,116,570 | 1/1964 | Torricelli | 52/284 X |
| 3,196,579 | 7/1965 | Lepper | 46/25 |
| 3,566,531 | 3/1971 | Hasel et al. | 46/25 |

FOREIGN PATENTS OR APPLICATIONS

| | | | |
|---|---|---|---|
| 1,355,044 | 2/1964 | France | 46/25 |
| 1,942,333 | 3/1971 | Germany | 46/25 |

*Primary Examiner*—J. Karl Bell
*Attorney, Agent, or Firm*—Steele & Petock

[57] ABSTRACT

A new building brick for use in the construction of buildings is disclosed. The brick is provided with projecting members and indentations on opposite surfaces. The projecting members and indentations provide resistance to lateral movement of the bricks. The bricks are held together in adjacent tiers by means of magnetic forces. The magnetic materials are located around the periphery of the projecting members and indentations or on the tops of the projecting members and the innermost portion of the indentation. In another embodiment, the bricks may be partially cured and held together by means of applying water to the surfaces to be joined and applying heat.

2 Claims, 9 Drawing Figures

BUILDING BRICK

BACKGROUND OF THE INVENTION

Present invention relates to a new type of building brick. More particularly, the present invention relates to a new type of building brick which does not require mortar in the construction of buildings.

Until the present invention, the construction of a brick building required the skills of a mason. In addition, labor had to be provided on the job site in connection with the preparation and handling of mortar.

The present invention enables the rapid construction of a building without the mixing of mortar. Furthermore, the construction of a building in accordance with the present invention does not require the skills of a mason.

SUMMARY OF THE INVENTION

An advantage of the present invention is that mortar is not required in the construction of buildings.

Another advantage of the present invention is that it eliminates the need for a skilled mason in the construction of a brick building.

Briefly, in accordance with the present invention, a building brick used for constructing buildings is provided. The brick is provided with two projecting locking members on a first surface and two locking indentations on a second surface opposite the first surface. The projecting locking members on a brick in a first tier of bricks are adapted to fit into the indentations of one or more bricks in an adjacent tier of bricks in order to prevent lateral motion. Magnetic means may be used for applying forces in order to attract bricks in adjacent tiers together.

In another embodiment of the present invention, the bricks may be comprised of partially dried clay and straw. The bricks are then held together by applying layers of water to the surfaces of the bricks to be bonded together. The bricks are laid in position for construction and heat is then applied to form a bond between the bricks intended to be bonded together.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
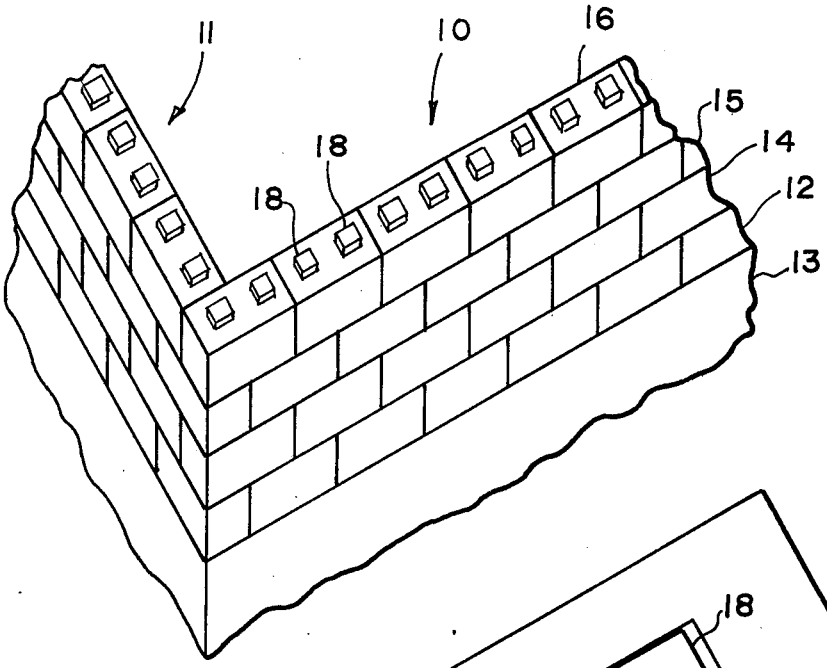
FIG. 1 is a view in perspective of a portion of a building being constructed with bricks in accordance with the present invention.

Referring now to the drawings in detail, there is shown in FIG. 1 partially constructed walls 10 and 11 comprised of building brick in accordance with the present invention. The walls are constructed by laying a first tier of bricks 12 on a suitable foundation 13 comprised of a suitable substance, such as concrete. A second tier of bricks 14 is laid on the first tier and positioned so that the center of bricks 14 overlay the joints of bricks 12. Similar tiers of bricks 15 and 16 are consecutively laid to form a wall.

Figure 2:
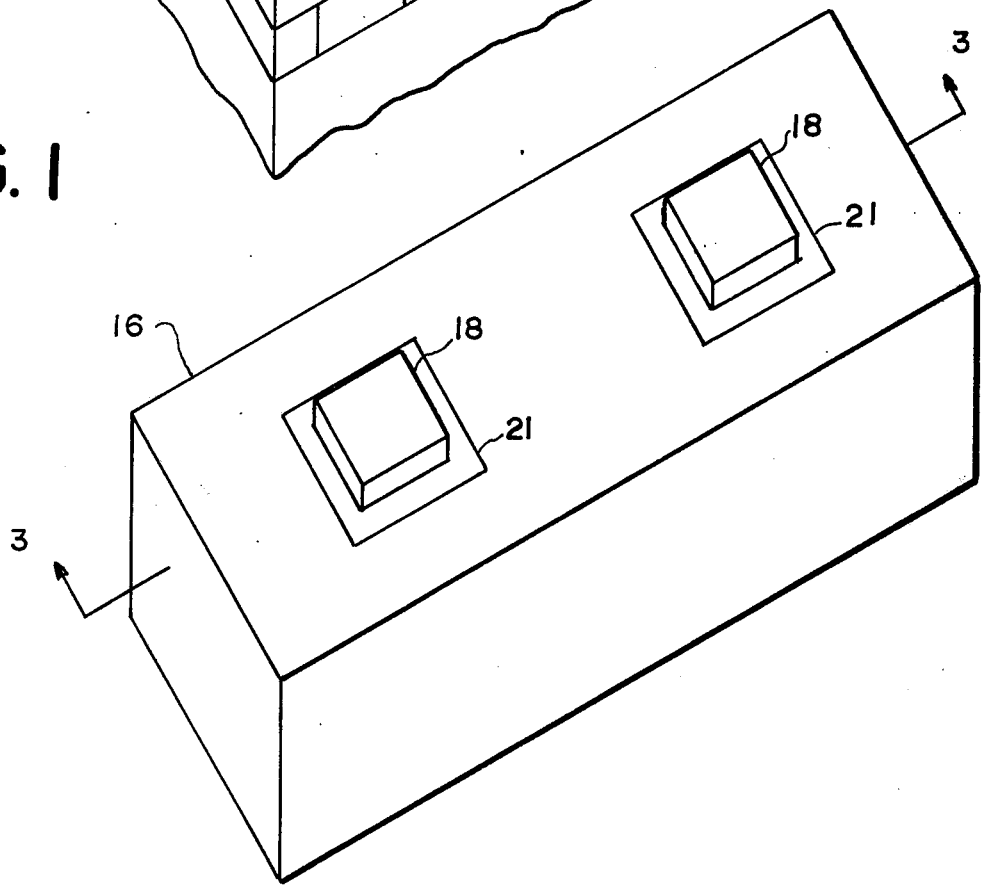
FIG. 2 is a view in perspective of a brick in accordance with the present invention.
Figure 3:
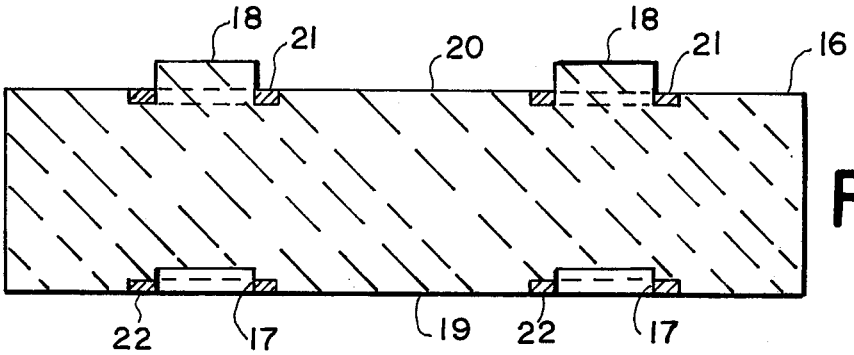
FIG. 3 is a cross-sectional view taken along line 3—3 of FIG. 2 in accordance with the present invention.

Referring now to FIGS. 1, 2 and 3 taken together, the structure of the building brick is shown in greater detail. Each building brick 16 is provided with two projecting locking members 18 on one of the surfaces as shown in FIGS. 1, 2 and 3. As may be seen from FIG. 3, each brick 16 is provided with a pair of locking indentations 17 on a surface opposite the surface of the projecting locking members. The locking indentations 17 are provided on surface 19 directly opposite the projection locking members 18 of surface 20. In constructing walls from the building bricks, the projecting locking members 18 fit into the locking indentations 17 of the next tier of bricks. For example, referring to FIG. 1, the projecting locking members of the bricks in tier 15 fit into the locking indentations 17 of building bricks 16 of the top tier. This locking arrangement of projecting members and indentations prevents lateral movement of the bricks.

The building bricks may be held together by means of magnetic forces or by bonding the bricks together as will be described hereinafter. Referring now to FIGS. 2 and 3, there are shown strips 21 and 22 of magnetic material embedded in the brick around the periphery of the projecting locking members 18 and the locking indentations 17. At least one of the pair of strip materials 21 and 22 are permanent magnets. Both pairs of strip materials 21 and 22 may be permanent magnets. However, if only one pair of strip materials 21 and 22 are permanent magnets, the other pair of strips 21 or 22 may be a suitable magnetic material such as iron or permalloy. As long as one of the pairs of strip materials 21 and 22 are permanent magnets, magnetic forces will be set up attracting the magnetic strip material of bricks in an adjacent tier. For example, using the numerical designations of FIG. 1, if the magnetic strip materials 21 surrounding the projecting members 18 on the bricks of tier 14 are permanent magnets, the strip materials 22 of the bricks of tier 15 surrounding the indentations on the bottom of the bricks may be a suitable magnetic material such as soft iron. Alternatively, all strip materials may be permanent magnets.

Figure 4:
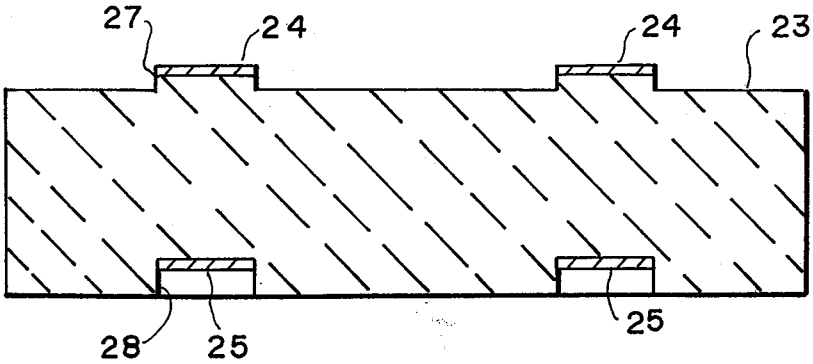
FIG. 4 is a cross-sectional view of another embodiment of the present invention using magnetic bonding forces.

Referring now to FIG. 4, there is shown a brick 23 in cross section representing another embodiment of the present invention. Brick 23 and the bricks shown in FIGS. 2, 3, 7, 8 and 9 may be constructed of conventional brick compositions such as clay which has been dried or fired. Brick 23 is provided with strips 24 and 25 comprised of a magnetic material. Strips 24 or strips 25 are comprised of permanent magnets. However, if desired, both strips 24 and 25 may be permanent magnets. As long as one of the strips 24 or 25 are comprised of permanent magnets, the other may be comprised of a magnetic material. When the bricks are put together in adjacent tiers, a permanent magnet will be adjacent a piece of magnetic material thereby creating attractive magnetic forces holding bricks in adjacent tiers together. Strips 24 are mounted in the outermost surface of projecting locking members 27 and magnetic strips 25 are mounted in the innermost surface of locking indentations 28.

Figure 5:
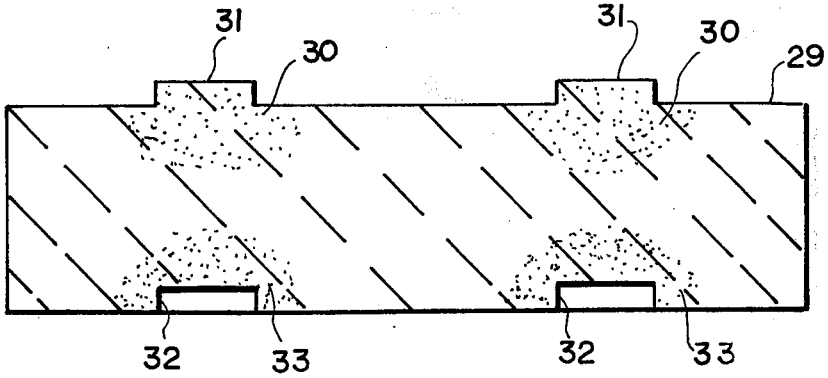
FIG. 5 is a cross-sectional view of a brick using magnetic bonding forces in accordance with another embodiment of the present invention.

Referring now to FIG. 5, there is shown a brick 29 illustrating another embodiment of the present invention. Magnetic particles 30 are placed in at least a portion of brick 29 during the brick manufacturing process. Preferably magnetic particles would be deposited in brick 29 in and around projection members 31 as shown at 30 and around indentations 32 as shown at 33. However, it is understood that magnetic particles could be distributed uniformly throughout brick 29. However, in order to produce the most economical manufacture of the brick, the magnetic particle distribution could be limited to specified areas such as around the projecting members 31 and indentations 32. The magnetic particles as shown in the cross-sectional representation of brick 29 may be permanent magnet particles or, for example, only the upper particle distributions 30 may be permanent magnets and the lower particle distributions 33 may be soft iron or permalloy particles or vice versa.

Figure 6:
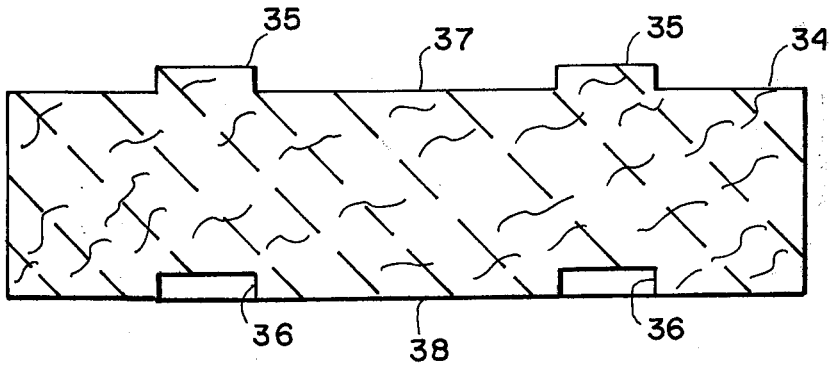
FIG. 6 is a cross-sectional view of a brick in accordance with another embodiment of the present invention.

Referring now to FIG. 6, there is shown another embodiment of the present invention illustrated by a cross-sectional view of a brick 34. Brick 34 is provided with projecting locking members 35 and indentations 36. In constructing a building or a wall with the bricks shown in FIG. 6, magnetic binding forces are not used to hold bricks in adjacent tiers together. Brick 34 is comprised of clay and straw in a partially dried state. The bricks are put together to form a structure as illustrated in FIG. 1. In putting the bricks together to form the structure of FIG. 1, a layer of water is applied to surfaces 37 and 38. Once the bricks 34 are assembled in this manner, heat is applied to fully dry the bricks and form a bond between the bricks by drying the water which was applied to surfaces 37 and 38. The heat may be applied by a radiation lamp. In this manner, the bricks in adjacent tiers are bonded together without the need of magnetic binding forces.

Figure 7:
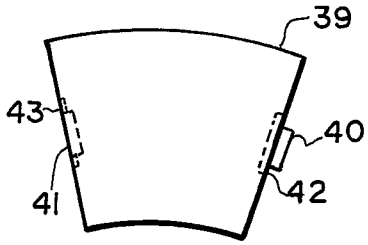
FIG. 7 is a side-elevation view of a special purpose brick in accordance with the present invention.

Referring now to FIG. 7, there is shown a special purpose type of brick 39 which may be used in archways and similar other applications. Brick 39 is provided wth a projecting member 40 and a corresponding lock indentation 41. Magnetic strips 42 and 43 are also provided. At least one of the magnetic strips 42 and 43 must be a permanent magnet as described above.

Figure 8:
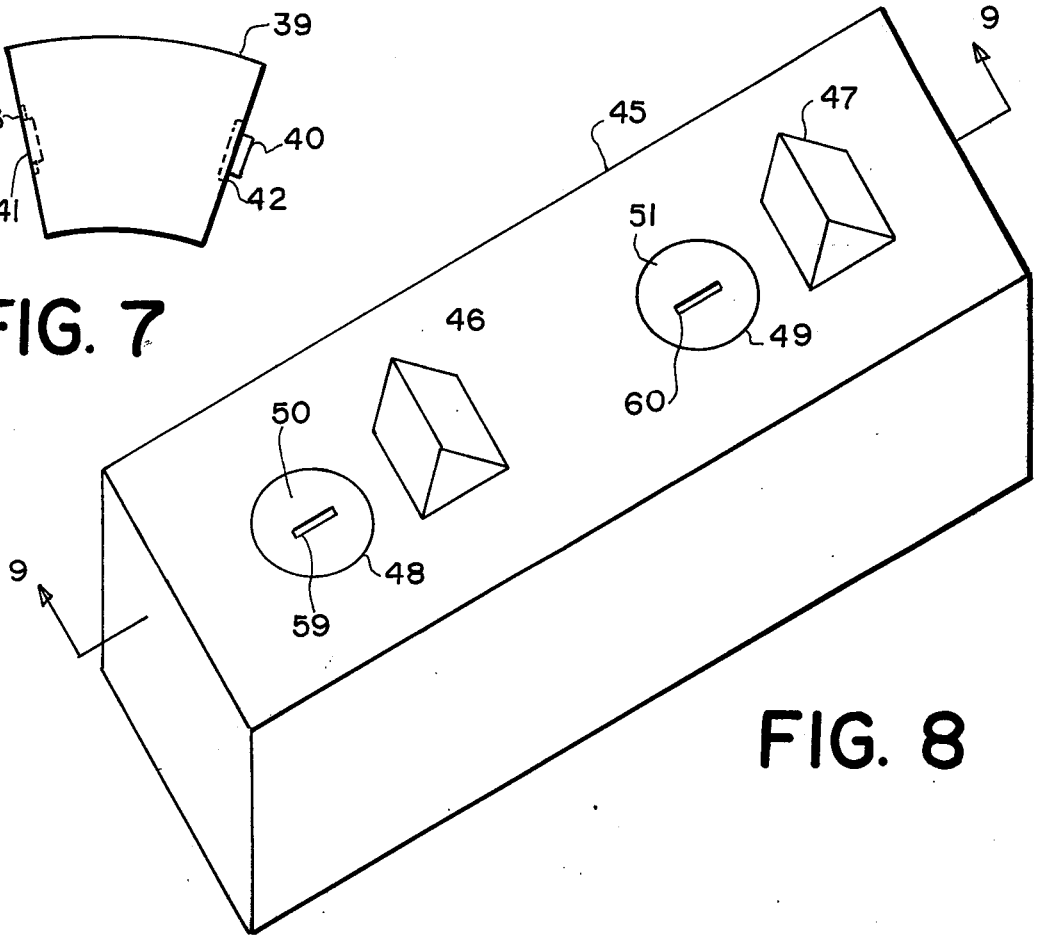
FIG. 8 is a view in perspective of still another embodiment of the present invention.

Referring now to FIG. 8, there is shown another embodiment of the present invention comprised of a brick 45 with a pair of triangular projecting locking members 46 and 47. Brick 45 is provided with threaded openings 48 and 49. The threaded openings are provided with threaded cylinders or plugs 50 and 51 which are comprised of a magnetic material.

Figure 9:
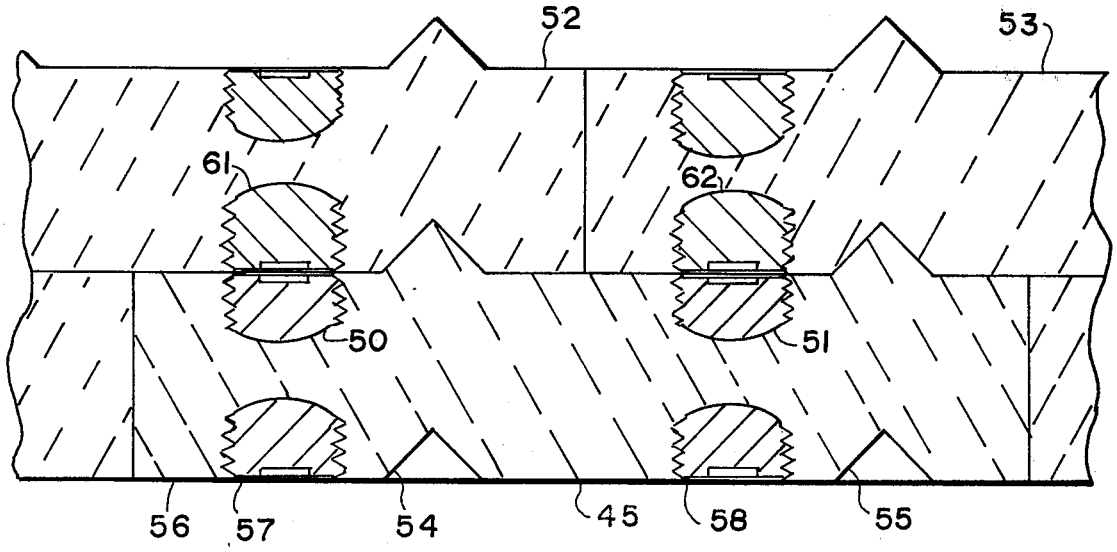
FIG. 9 is a cross-sectional view of a construction of a plurality of bricks of FIG. 8 taken along line 9—9 of FIG. 8.

FIG. 9 illustrates a cross-sectional view of brick 45 in conjunction with cross-sectional views of mating bricks 52 and 53. Brick 45 is also provided with triangular indentations 54 and 55 in a surface opposite the surface carrying projecting members 46 and 47. The lower surface 56 is also provided with threaded cylinders or plugs 57 and 58 of magnetic material. The cylinders or plugs are provided with screwdriver slots as shown at 59 and 60.

The triangular projecting members 46 and 47 in conjunction with mating indentations of bricks in adjacent tiers as shown in FIG. 9 prevent lateral movement of the bricks. The plugs in the upper or lower surface are permanent magnets. Alternatively, the plugs in both the upper and lower surfaces may be permanent magnets. The plugs 50 and 51 of magnetic material set up attractive forces with plugs 61 and 62, respectively, of bricks 52 and 53, respectively.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. A building brick used for constructing buildings, comprising:

a clay building brick provided with two projecting locking members on a first surface and two locking indentations on a second surface opposite said first surface whereby said projecting locking members on a building brick in a first tier of bricks are adapted to fit into the indentations of one or more bricks in an adjacent tier of bricks; and magnetic particles distributed inside said bricks underneath each of said projecting locking members and each of said locking indentations, and the magnetic particles underneath at least one of each of two adjacent bricks surfaces being permanently magnetized in order to provide a magnetic attraction force between bricks in adjacent tiers.

2. A building brick used for constructing buildings, comprising:

a clay building brick provided wth two projecting locking members on a first surface and two locking indentations on a second surface opposite said first surface whereby said projecting locking members on a building brick in a first tier of bricks are adapted to fit into the indentations of one or more bricks in an adjacent tier of bricks;

said projecting locking members and said projecting locking indentations being triangular in cross-section; and each brick being provided with at least one threaded opening on each of two opposite surfaces for receiving threaded cylinders of magnetic material, at least one of which is permanently magnetized, in order to provide a magnetic attraction force between bricks in adjacent tiers.

* * * * *